US010276360B2

(12) United States Patent
Cornish et al.

(10) Patent No.: US 10,276,360 B2
(45) **Date of Patent: *Apr. 30, 2019**

(54) MINIATURE TIME-OF-FLIGHT MASS SPECTROMETER

(71) Applicant: Zeteo Tech, Inc., Sykesville, MD (US)

(72) Inventors: Timothy Cornish, Columbia, MD (US); Scott Ecelberger, Columbia, MD (US)

(73) Assignee: Zeteo Tech, Inc., Sykesville, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/443,825

(22) Filed: Feb. 27, 2017

(65) Prior Publication Data

US 2017/0358439 A1 Dec. 14, 2017

Related U.S. Application Data

(63) Continuation of application No. 14/407,531, filed as application No. PCT/US2013/045450 on Jun. 12, 2013, now Pat. No. 9,583,327.

(60) Provisional application No. 61/658,576, filed on Jun. 12, 2012.

(51) Int. Cl.

| | |
|---|---|
| ***H01J 49/00*** | (2006.01) |
| ***H01J 49/40*** | (2006.01) |
| ***H01J 49/02*** | (2006.01) |

(52) U.S. Cl.

CPC ..... *H01J 49/405* (2013.01); *H01J 49/0013* (2013.01); *H01J 49/025* (2013.01)

(58) Field of Classification Search

CPC ..... H01J 49/0013; H01J 49/025; H01J 49/405

See application file for complete search history.

(56) References Cited

U.S. PATENT DOCUMENTS

| | | | | |
|---|---|---|---|---|
| 5,464,985 | A | 11/1995 | Cornish et al. | |
| 6,888,130 | B1 * | 5/2005 | Gonin | H01J 49/027 250/281 |
| 9,583,327 | B2 * | 2/2017 | Cornish | H01J 49/0013 |
| 2002/0060289 | A1 | 5/2002 | Cornish et al. | |
| 2003/0047679 | A1 | 3/2003 | Cornish et al. | |
| 2004/0195501 | A1 * | 10/2004 | Cornish | H01J 49/0013 250/287 |
| 2008/0272289 | A1 | 11/2008 | Vestal | |
| 2010/0072363 | A1 | 3/2010 | Giles et al. | |
| 2010/0327157 | A1 * | 12/2010 | Green | H01J 49/065 250/282 |
| 2014/0084155 | A1 | 3/2014 | Li et al. | |

FOREIGN PATENT DOCUMENTS

| | | | |
|---|---|---|---|
| GB | 2392305 | A | 2/2004 |
| WO | 2004/008470 | A2 | 1/2004 |

* cited by examiner

*Primary Examiner* — Wyatt A Stoffa
*Assistant Examiner* — Hsien C Tsai
(74) *Attorney, Agent, or Firm* — Polsinelli PC

(57) ABSTRACT

A miniature time-of-flight mass spectrometer (TOF-MS) was developed for a NASA/ASTID program beginning 2008. The primary targeted application for this technology is the detection of non-volatile (refractory) and biological materials on landed planetary missions. Both atmospheric and airless bodies are potential candidate destinations for the purpose of characterizing mineralogy, and searching for evidence of existing or extant biological activity.

12 Claims, 8 Drawing Sheets

$P_{14}R$ Gate Seleted
$P_{14}R$ Product Ions

Angiotensin II Gate Selected
Angiotensin Product Ions

Mixture Angio II + $P_{14}R$ Gate OFF
Matrix Ions
Angiotensin II
$P_{14}R$
Mass (u)
0.1
200.0
400.0
600.0
800.0
1000.0
1200.0
1400.0
1600.0
1818

CERI Pulsed Pin Gate
Lead Solder sample

Lead (208 Da)

Tin (118 Da)

Potassium (39 Da)
Mass (u)
0.03
0.02
0.01
0.00
21.0
50.0
100.0
150.0
200.0
250.0
300.0
350.0
400.0
450.0
462.4

MINIATURE TIME-OF-FLIGHT MASS SPECTROMETER

CROSS REFERENCE TO RELATED APPLICATIONS

The present patent application is a continuation of U.S. patent application Ser. No. 14/407,531, filed Dec. 12, 2014, which application is a 371 of International Patent Application No. PCT/US2013/045450, which was filed with the U.S. Receiving Office on Jun. 12, 2013, entitled "MINIATURE TIME-OF-FLIGHT MASS SPECTROMETER," which claims priority to U.S. Provisional Patent Application No. 61/658,576, filed Jun. 12, 2012, and entitled Miniature Time-of-flight Mass Spectrometer, the contents of each of which are incorporated herein by reference in their entirety.

BACKGROUND

Miniature mass spectrometers frequently exhibit reduced performance compared to laboratory instruments, and are difficult and expensive to maintain and repair. The miniature time of flight mass spectrometer (TOF-MS) disclosed herein addresses this and other problems.

SUMMARY

The present disclosure is directed to miniature TOF-MS and its separate components. The instrument includes a source region, detector block containing linear and reflectron detectors and an pulse pin ion gate, and a wire ring reflectron.

The detector block is designed of unitary construction for rigidity and efficiency. The two detectors allow simultaneous detection of linear and reflectron molecular species. The pulse pin ion gate allows very narrow mass selection in a small dimension instrument.

Separately, the wire ring reflectron provides a low weight reflectron capable of advanced analysis of precursor ions. In embodiments in which the reflectron is a non-linear reflectron created by differently spaced ring elements, the size required is reduced and the required electric components are easily fabricated.

The mass spectrometer is adapted to any laser based ion source, including laser ablation mass spectrometer for detection of non-volatile compounds.

DETAILED DESCRIPTION

Figure 1:
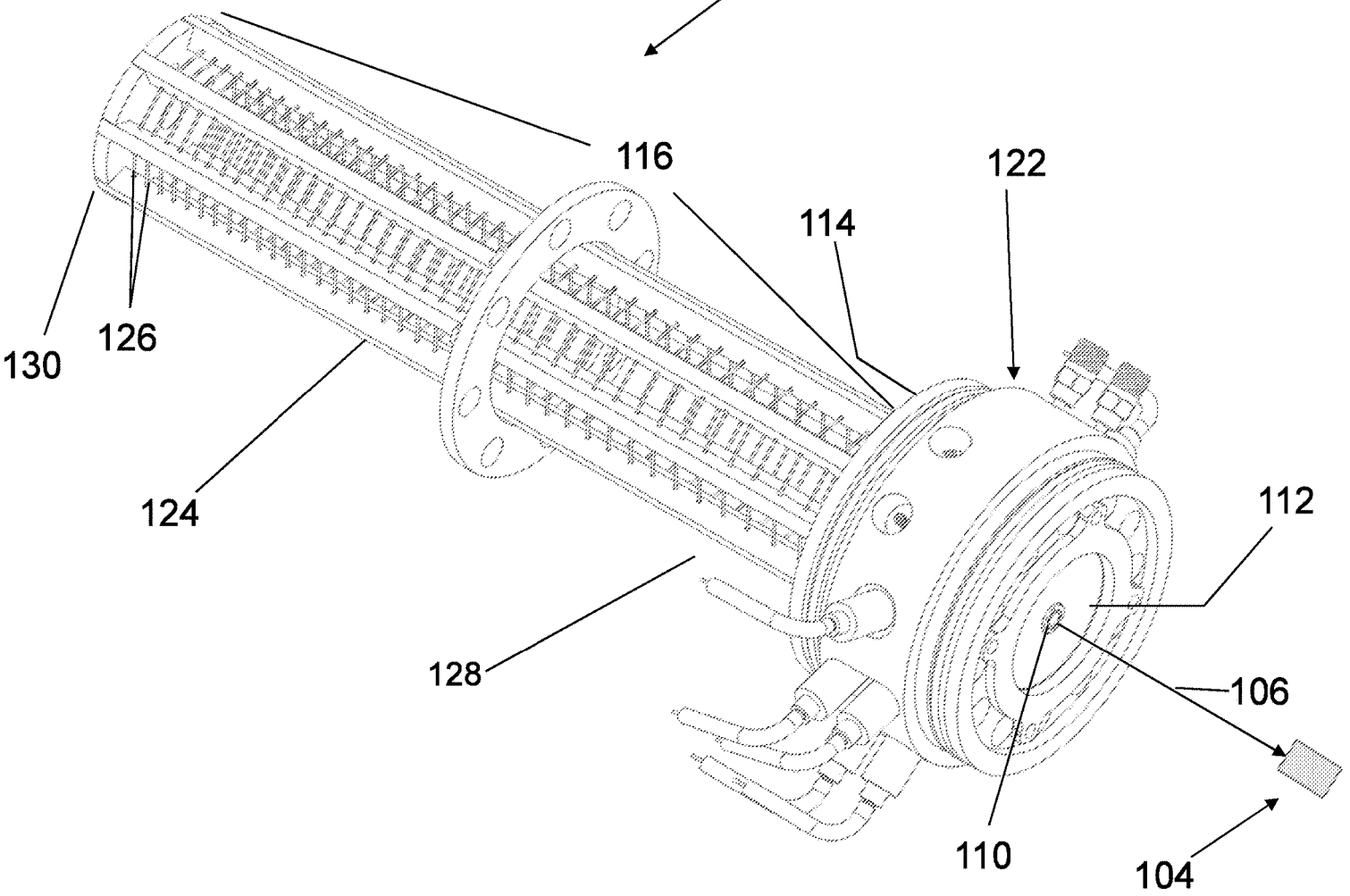
FIG. 1 depicts a cut-away perspective of a miniature time of flight instrument embodiment.

A miniature time-of-flight mass spectrometer (TOF-MS) is described herein. An embodiment of the device is depicted in FIG. 1. In various aspects, the mass spectrometer is adapted to detect low and non-volatile molecules in a miniature instrument that can be adapted to field portable applications.

FIG. 1 depicts a three dimensional cut-away view of one aspect of the miniature TOF-MS 100. The entire mass spectrometer is evacuated to high vacuum (at, or lower than, 1×10−6 torr). A non-volatile sample (not shown) is introduced into the source region 104, where a pulsed laser beam 106 impinges on the sample surface (not shown). As depicted in FIG. 1, the laser beam 106 is directed down the center axis 110 of the miniature TOF-MS instrument 100, though it is contemplated that the beam can come from any direction such as from a side or diagonal position. Ions are created, and are subsequently accelerated towards the drift region by fixed or pulsed high voltage potentials. Lighter mass ions achieve the highest velocity, and reach a linear detector 112 or a reflectron detector 114 first, while the heavier mass ions arrive at the detector at a later time. The mass of the ion is determined by squaring the arrival time of that particular mass ion at the detector, and multiplying by a constant, a value characteristic of that particular analyzer.

In the linear detector 112, ions travel for a shorter time between leaving the source region 104 and reaching the detector 112, which results in lower resolution of mass peaks. Longer flight times, and increased mass resolution, can be achieved if the ions are allowed to enter the ion reflector 116 (sometimes called a "reflectron" or "ion mirror"). Here, the flight path is effectively doubled, and the flight times are increased (e.g. by a factor of 4) due to the gradual slowing and reversing of the ion path through the reflectron 116. If a particular mass is to be isolated for advanced analysis (e.g. characterization of molecular ion fragmentation), the ion gate (not shown, inside detector block 122) is pulsed, allowing only selected mass ions to pass through the gate and continue towards the linear detector 112 or reflectron detector 114.

In various embodiments, the miniature TOF-MS is capable of detecting any analyte, particularly non-volatile (refractory) and biological materials. The present miniature TOF-MS can be configured to act as a laser ablation mass spectrometer for detection of non-volatile compounds in planetary exploration and field-portable terrestrial applications.

The instrument can be any length, and can be as small as 1 inch, 2 inches, 3 inches, 4 inches, 5 inches, 6 inches, 7 inches, 8 inches, 9 inches, 10 inches, 11 inches, or 12 inches in length.

Aspects of the presently miniature TOF-MS are described in more detail herein. It is contemplated that each component can be used as a unit with the components disclosed in FIG. 1, or separately and with any other TOF-MS instrument known in the art.

Source and Ion Focusing Optics

The source region can be any source designed to accelerate ions in a time of flight mass spectrometry.

In some embodiments, the source can be any surface desorption method, including matrix assisted laser desorption/ionization (MALDI), AP-MALDI, plasma desorption/ionization, chemical ionization, and/or other types of surface ionization. The laser can be any laser known for use in MALDI or desorption methods, including pulsed UV or IR lasers. The device can also be adapted to laser ablation methods.

The focusing optics can include any focusing optics suitable for an ion beam, including ion focusing elements (e.g. einzel lens).

Detector Block

Figure 2:
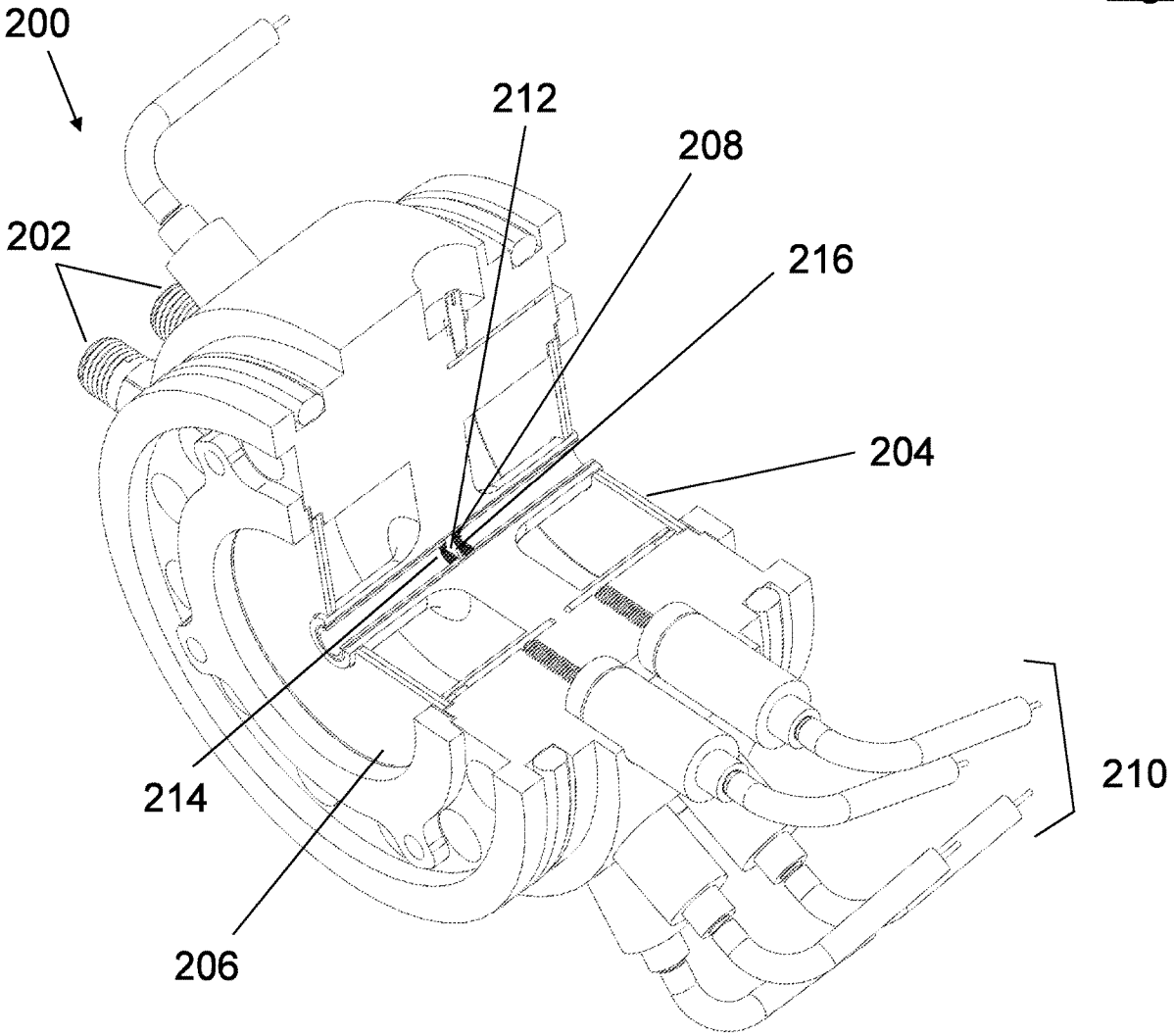
FIG. 2 depicts a cut-away perspective of a detector block embodiment.

The detector block 122 depicted in FIG. 1 is shown in more detail in FIG. 2. The detector block 200 also incorporates all of the vacuum feedthroughs 202 for the application of high voltage to the internal components within the evacuated instrument. Specifically, the detector block 200 is a unitary detector block in which all components, including linear detector 204 and reflectron detector 206, pulsed pin ion gate 208 that includes a pin 212 and two grids (Grid A 214 and Grid B 216), HV feedthroughs 210, and detector anodes. The unitary construction provides greater rigidity to impact, while including all components in the mass spectrometer. The combination of components simplifies assembly and repair of the analyzer. As depicted in FIG. 1, vacuum "cans" (i.e. sleeves with sealed ends) are sealed onto o-rings located in the detector housing block. All high voltage leads are attached to the vacuum housing at the center of the instrument. Consolidating the complexity of the electronics and feedthroughs into a single central detector block also reduces fabrication costs.

Pulsed Pin Ion Gate

A pulsed pin ion gate 300 is embedded into the center of the detector block. The ion gate allows for removal (i.e. gating) of ions having particular ion mass or range of ion masses for further analysis.

Figure 3:
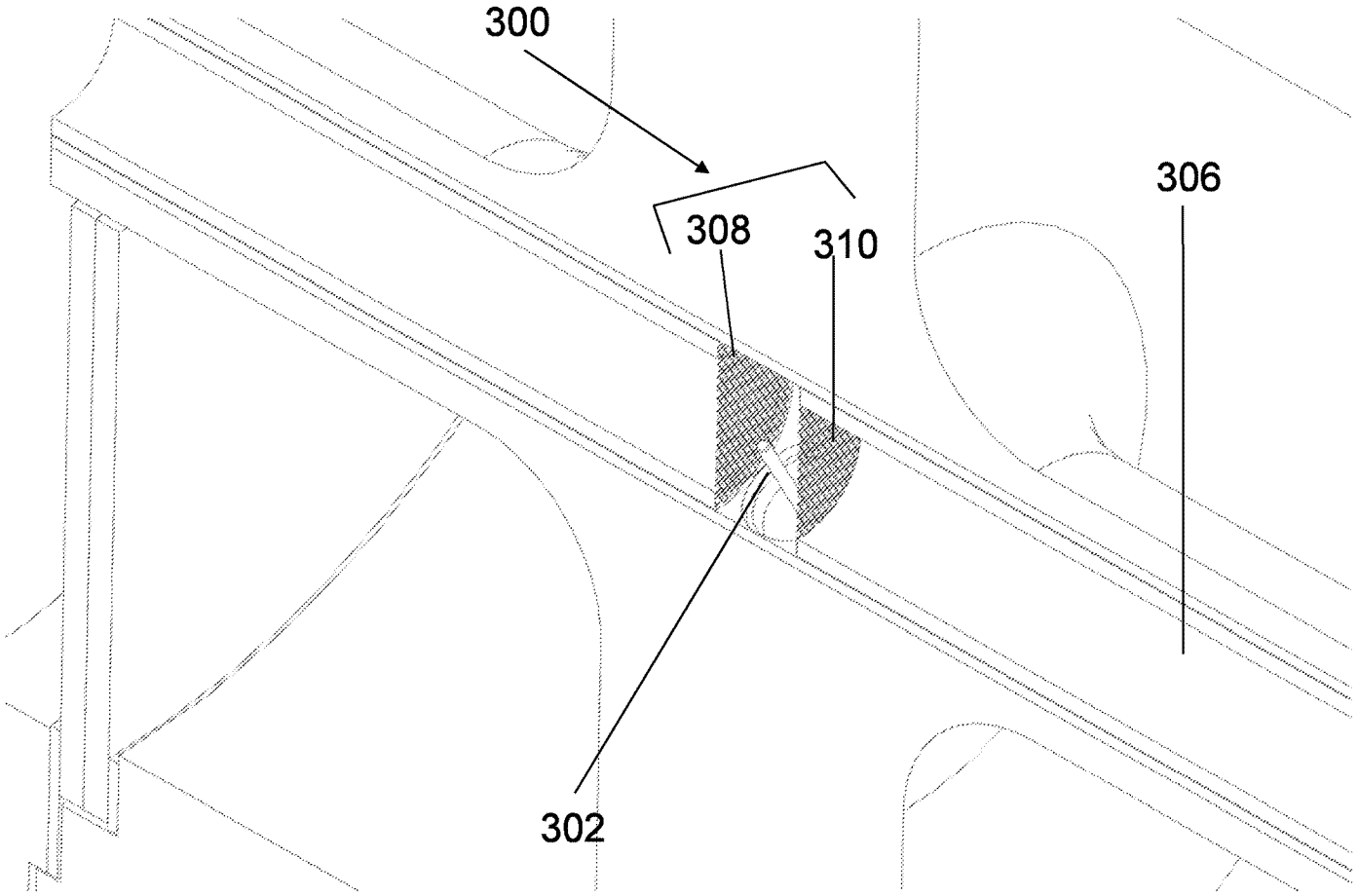
FIG. 3 depicts a cut-away version of a pulse pin ion gate.

Ion gates allow the passage of ions in a selected mass range. As depicted in FIG. 3, an electrically isolated pin 302 is inserted into the detector block and protrudes into the ion flight path 306. Two high transmission grids A 308 and B 310 are disposed at two locations in the ion flight path 306 on either side of the ion gate 300. Grid A 308 is disposed in the ion flight path 306 proximal to the source region 316 from the pin 302, and grid B 310 is disposed distal from the source region (not shown) on the other side of the pin 302. Grid A 308 and grid B 310 keep the pulse pin potential from propagating into the flight tube beyond the grid A 308 and grid B 310, thereby allowing narrower mass selection of ions in the ion beam.

When the pin 302 is at the same potential as the ion flight path 306 and grids 308 and 310, ions do not deviate from their trajectory in the ion flight path 306. When the pin 302 is at a different potential from the ion flight path 306, ions deviate from their trajectory, and do not reach the reflectron detector 314. By timing the pin 302 to have the same potential as the ion flight path 306 when specific ions pass through the ion gate 300 and a different potential when unwanted ions pass through the ion gate 300, specific ions or groups of ions can be selected for further analysis.

In various embodiments, the grids 308 and 310 are high transmission grids. In various embodiments, the transmission efficiency can be 80%, 85%, 88%, or 90%. The grids 308 and 310 can be constructed of any suitable material known in the art, for example nickel mesh material.

A pulse potential can be applied to the pin 302 of the ion gate 300 by any means known in the art. In various embodiments, the pin 302 is connected to a pulse generator that generates a pulse potential. In various embodiments, the pulse can be a square wave. The pulse time can be any time induced by control electronics. In some aspects the pulse width can be 25 ns, 50 ns, 75 ns, 100 ns, 130 ns, 150 ns, 170 ns, 200 ns, 250 ns, 300 ns, 350 ns, 400 ns, 450 ns, 500 ns, 550 ns, 600 ns, 650 ns, 700 ns, 750 ns, 800 ns, 850 ns, 900 ns, 950 ns, or 1000 ns.

The ion gate 300 can be used to gate out all masses below a specific mass. Alternatively, masses above a certain mass can be gated out. In some instances, more than one mass range can be selected, by for example, using a quick-recovery pulse generator.

The pin 302 in a pulse pin gate can be any type of conductive material inserted close to the ion flight path 306. The pulse pin can be any shape (e.g., having a circular or square cross-section) provided that it causes ions to diverge from the ion beam when the pin is pulsed at a different potential from the drift region and grids. As long as the pin is configured to affect the ion beam when the pin is pulsed, the pin can be disposed at any position relative to the drift region. In various non-limiting embodiments, the pulsed pin can protrude into the drift channel of the detector assembly, be held on flush with the edge of the drift tube, be withdrawn from the drift tube, extend directly into the ion beam.

In various embodiments, grids A 306 and grid B 308 are spaced apart by a defined distance. More narrowly spaced grids allow a narrower packet of ion masses to be selected by the gate. In some instances, the space separating the grid is 1.0 mm, 1.5 mm, 2.0 mm, 2.5 mm, 3.0 mm, 3.5 mm, 4.0 mm, 5.0 mm, 6.0 mm. 7.0 mm, 8.0 mm, 9.0 mm, or 10.0 mm. Since the tubes (and grids) are held at the drift potential, application of high voltage to the pin promotes wide deflection to that portion of the ion beam within the grid spacing. Unlike other gates (e.g. the Bradbury-Nielsen gate), the pulse pin ion gate 300 is simple to fabricate, requires only a single high voltage pulse, and has an adjustable "window" by variation in the surrounding grid spacing.

The pulsed pin ion gate 300 may be made of any conductive material, such as copper. Grid A 306 and grid B 308 can be made of any material that can be used to make high transmission gates, e.g. a nickel mesh.

Linear and Reflectron Detectors

As depicted in FIG. 2, the linear detector 204 and reflectron detector 206 are channel plate detectors. As depicted in FIG. 2, both the linear and reflectron channel plate detector includes two channel plates that are held together by a clamp. The channel plates are held at a negative potential. When an ion impacts the channel plate, the channel plate releases electrons that propagate to the second channel plate, and induce a signal in an output electrode. The pin electrode propagates the signal to detection electronics (such as an oscilloscope).

In various additional embodiments, one or more channel plates can be configured in detectors. Two, three, or more channel plates can be held together.

Wire Ring Ion Reflectron

As depicted in FIG. 1, the wire ring ion reflector 116 uses a cylindrically framed instrument structure. The reflectron can be any type of reflectron known in the art, including a linear reflectron, or a non-linear reflectron such as a curved field reflectron.

The wire ring reflectron 116 includes an electrically non-conductive cylindrical frame 124, with a plurality of conductive wire elements 126 each surrounding the cross section of the cylindrical frame to create a cylindrical wire ring reflectron 116 having a proximal end 128 and a distal end 130. Each adjacent wire element is electrically connected by a resistors (not shown), such as a variable resistor or a constant resistor.

It is noted that cylindrical reflectron requires only that the rings, optionally wire rings, surround the center axis of the reflectron. Thus, each wire ring can be a series of straight sections surrounding the reflectron and still be considered cylindrical. The cylindrical shape can be, e.g., pentagonal, hexagonal, heptagonal, octagonal, etc. and still be considered cylindrical.

In a linear reflectron, the potential at the center of the reflectron increases linearly from the proximal end of the reflectron as a function of distance into the reflectron. In certain embodiments, both the resistance and distance between elements is constant. In non-linear reflectrons, the potential at the center of the reflectron increases non-linearly with an increasing slope from the proximal end to the distal end of the reflectron. In one embodiment, this can be accomplished when each successive resistor between elements from the proximal end to the distal end of the reflectron has a decreased resistance. In another embodiment, this can be accomplished when the distance between each wire elements decreases from the proximal end of the reflectron to the distal end of the reflectron.

Figure 4:
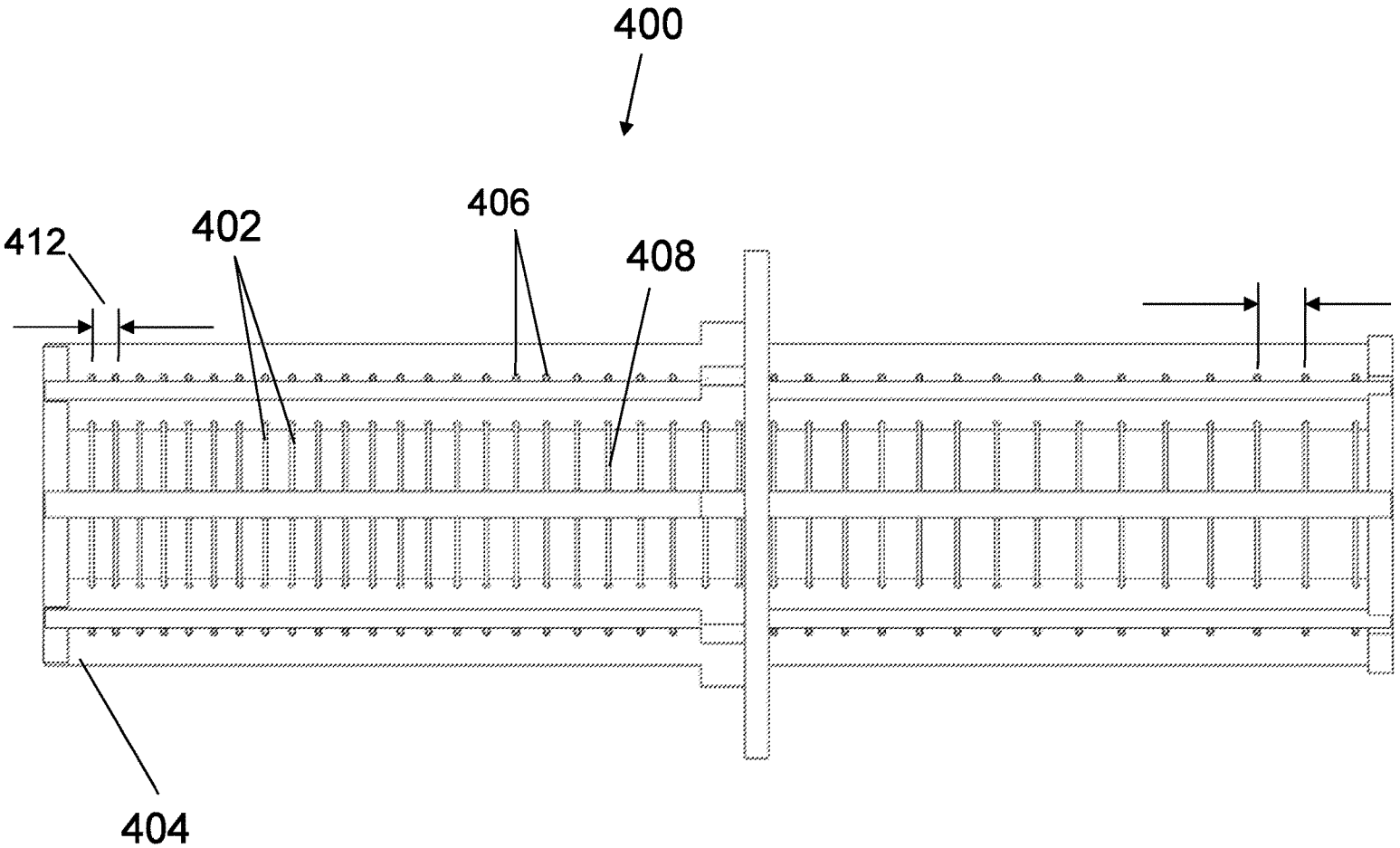
FIG. 4 depicts a side view of a wire ring reflectron.

An embodiment of the wire ring reflectron is depicted in FIG. 4. As depicted in FIG. 4, the wire ring ion reflectron is a curved field reflectron (CFR). The curved field energy-focuses ions formed after initial acceleration in time-of-flight (TOF) mass spectrometers. Typically, the ions are formed in the field-free drift region prior to their reflection. The focal lengths of the reflected ions in the CFR are not proportional to the mass (energy) of the fragment, and instead focuses post-source decay ions at the reflectron detector. The first two rings have a greater spacing distance 410 than the last two rings 412. Thus, fragment peaks are resolved without scanning or stepping the potential gradient of the reflectron. An example of such a CFR is described in U.S. Pat. No. 5,464,985, which is incorporated herein by reference.

The reflection rails can be made of any non-conductive material, such as polycarbonate. The ring elements can be made of any conductive material, including wire (e.g. copper wire).

In the design of FIG. 4, the curved field reflectron is achieved by placing a series of ring elements, each separated by a constant resistance. The potential of each ring element increases stepwise toward the rear of the reflectron. However, each successive ring element is spaced more closely than the previous ring. Thus, the potential affecting ions at the center of the reflectron increases non-linearly due to spacing of elements.

In the embodiment depicted in FIG. 4, each element of the reflectron 400 is constructed out of a wire ring 402. Each element can be circular, or another shape such as hexagonal. The wire ring can be wound around a support structure 404, or can be designed to allow a series a holes 406 to be drilled for accommodation of conductor wire loops 408 to be threaded through the holes 406 forming the ion reflector elements.

The support structure 404 can be made out of any material known in the art suitable for a non-conductive support structure. The support structure 404 can be selected from materials that have lower amounts of outgassing to allow lower vacuums in the mass spectrometer. The support structure 404 can further be selected from lightweight components to allow for improved portability. The support structure 404 can also be designed for rigid materials for rugged use associated with various applications.

The materials for the reflectron provide a lightweight design suitable for instrument portability. The open architecture allows rapid pumping, and the variable spacing in the hole pattern to fabricate non-linear ion reflectrons.

Curvature is same the curve that was originally published. It's the arc of a circle.

In various embodiments, any number of ring elements can be included.

The integrated design of the detector block allows for simple assembly and repair, low fabrication cost, and a highly ruggedized package made primarily from lightweight components, such as plastic. The pulsed pin ion gate requires only a single HV pulse for operation, and the single copper pin is easily fitted into the detector block assembly. Wire frame reflectron features a lightweight design, open architecture for rapid pumping, and simple accommodation of variable spacing in the hole pattern to fabricate non-linear ion reflectors.

Channel Plate, Drift Region, and Gating Potentials

In various applications, the channel plates in the detector have the same potential as the drift region. Examples of such potentials are 1 kV, 2 kV, 2.7 kV, 3 kV, or 4 kV. If the flight tube is at the same potential as the channel plate and the reflectron potentials are designed relative to the channel plates, no grid is required in front of the channel plate in order to keep the potential of the channel plate from affecting the time of flight of the ions. The design therefore provides less potential for arcing between the detector and grid in operation. The design also allows increased transmission of ions due to the absence of any grid that would inhibit transmission. The pin anode used in the detector can be at ground. That way, when the electrons hit the surface, the pin is at ground potential allowing for easier coupling to the detection electronics. Gating potentials for the pulsed pin ion gate can be any potential that varies from the potential of the drift region.

In various additional embodiments, grids can be placed in front of each channel plate detector. The grids are kept at the same potential as the rest of the instrument. The potential difference between the grid and the channel plate allows for increased potential applied to the channel plate, and therefore a larger detection signal and increased sensitivity for post-source detection of product ions. Such embodiments allow the drift region to have a zero potential. In various additional applications, the drift region of the instrument can be at a non-zero potential. When grids are used at the detectors, post acceleration of the ions before they hit the detector, provides higher sensitivity.

Applications

The miniature TOF-MS described herein, and its components, provide a highly efficient field portable instrument.

The completed Miniature TOF-MS features simple operation, rapid analysis time, relatively inexpensive purchase price (compared to Lab Scale instruments of comparable capabilities).

The field portability of the miniature TOF-MS disclosed herein can be used for a variety of applications. The mass spectrometer, and/or components thereof, can be used to detect volatile and non-volatile analytes.

In some aspects, the miniature TOF-MS can be used to detect non-volatile (refractory) and biological materials on landed planetary missions. Both atmospheric and airless bodies are potential candidate destinations for the purpose of characterizing mineralogy, and searching for evidence of existing or extant biological activity. Applications include detection of weapons of mass destruction, as well as chemical and bioterrorism components. Components of nuclear forensics can be detected at high efficiency. The device can be used in forensic analysis, agricultural analysis (e.g. detection of plant pathogens, soil contamination, fertilizer management), and oceanographic Analysis (e.g. detection of harmful algal bloom detection and verification).

EXAMPLES

The following non-limiting examples are for illustration purposes only, and do not limit the scope of the disclosure herein.

Example 1

Figure 5A:
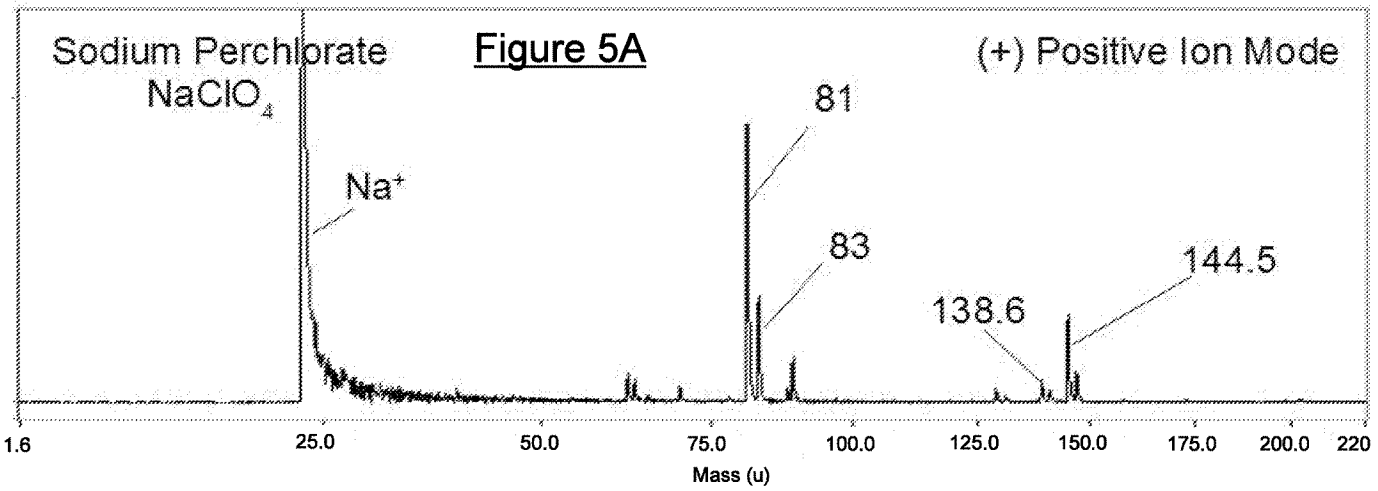
FIG. 5A shows positive ion mass spectrum of sodium perchlorate.
Figure 5B:
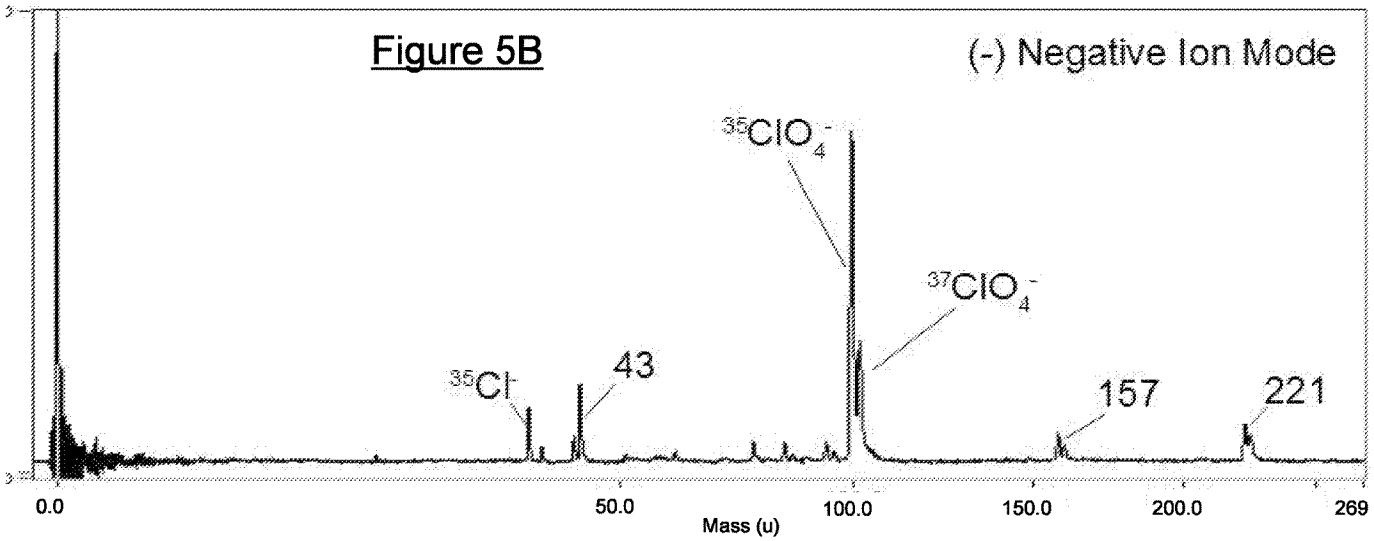
FIG. 5B shows a negative ion mode for sodium perchlorate.

FIG. 5A shows positive ion mass spectrum of sodium perchlorate. FIG. 5B shows a negative ion mode for sodium perchlorate. The spectra together demonstrated that the instrument can function in both positive ion and negative ion modes.

Example 2

Figure 6A:
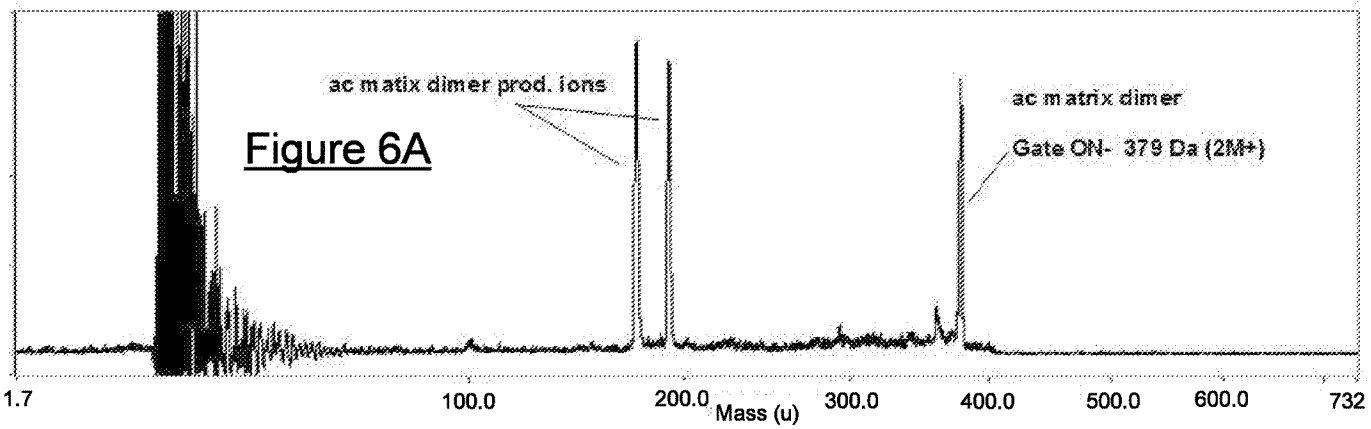
FIG. 6A shows a mass spectrum of α-cyano-4-hydroxycinnamic acid and its product ions when α-cyano-4-hydroxycinnamic acid is selected with the ion gate.
Figure 6B:
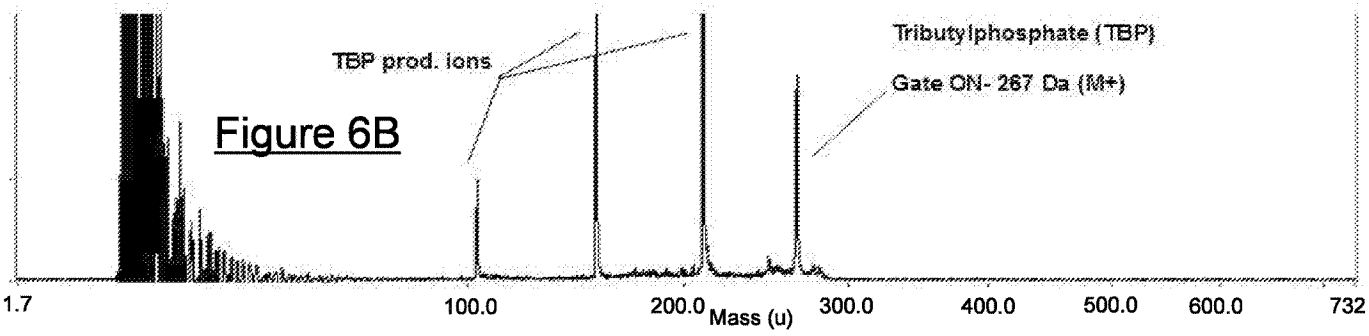
FIG. 6B shows a mass spectrum of tributylphosphate and its product ions when tributylphosphate was selected with the ion gate.
Figure 6C:
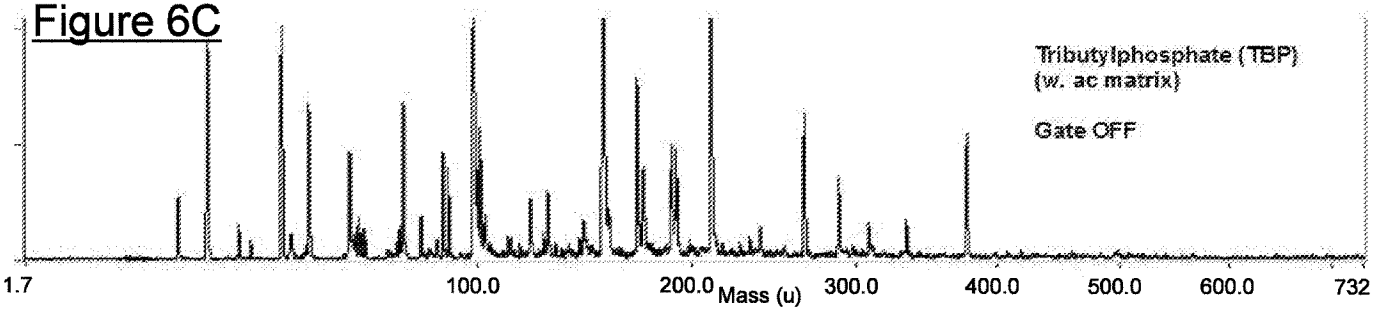
FIG. 6C shows a spectrum of tributylphosphate as an analyte in a MALDI mass spectrum using α-cyano-4-hydroxycinnamic acid without the gate.

FIG. 6C shows a spectrum of tributylphosphate as an analyte in a MALDI mass spectrum using α-cyano-4-hydroxycinnamic acid without the gate. Multiple ions and product ions are depicted, including α-cyano-4-hydroxycinnamic acid matrix ions (and product ions) and tributylphosphate (and product ions). FIG. 6A shows a mass spectrum of α-cyano-4-hydroxycinnamic acid and its product ions when α-cyano-4-hydroxycinnamic acid is selected with the ion gate. FIG. 6B shows a mass spectrum of tributylphosphate and its product ions when tributylphosphate was selected with the ion gate. Together, the spectra show that ions can be gated to produce product ion spectra.

Example 3

Figures 7A, 7B, 7C:
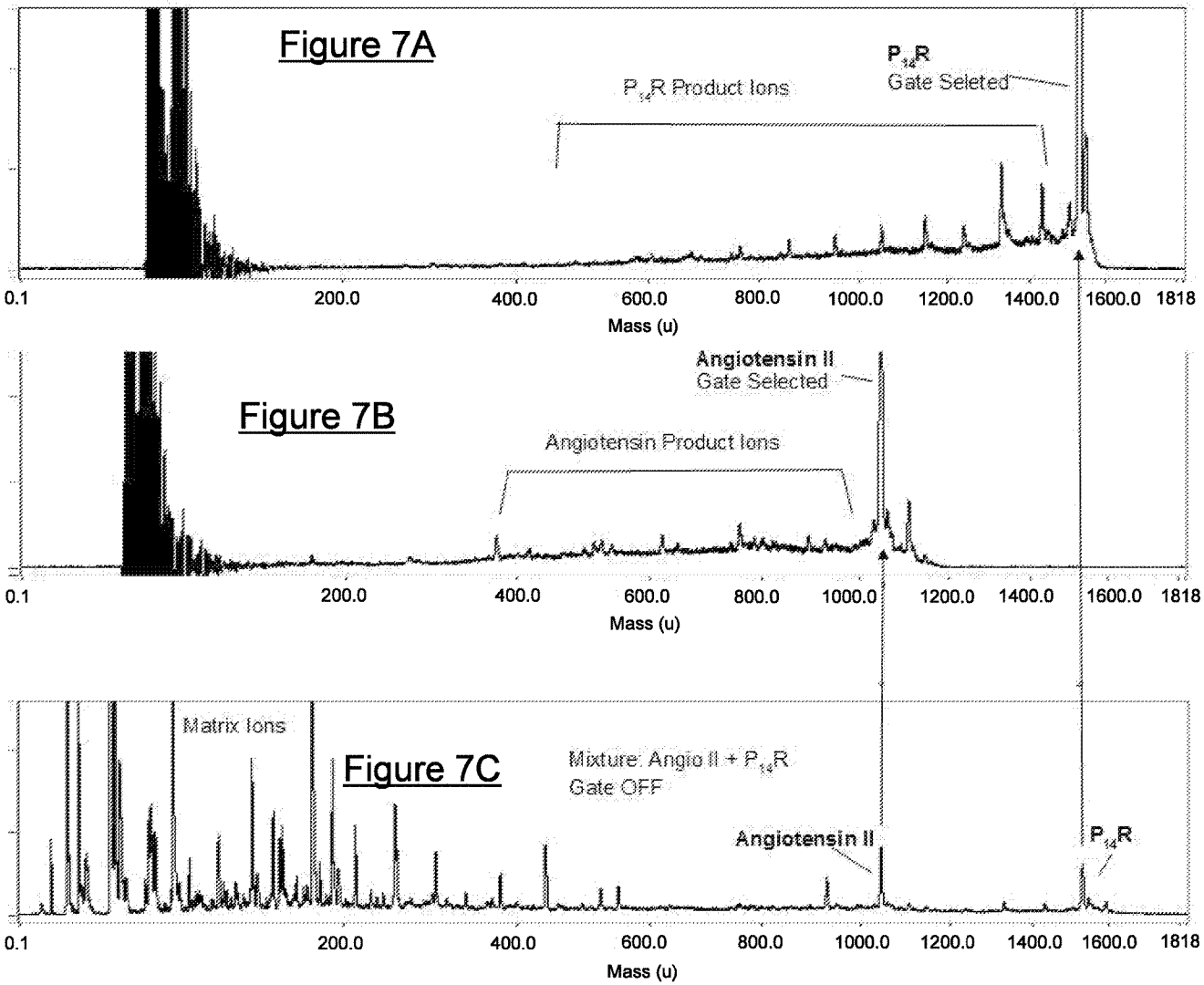
FIG. 7A shows the selection of $P_{14}R$ with the ion gate.
FIG. 7B shows angiotensin II selected with the ion gate.
FIG. 7C shows a mixture of $P_{14}R$ and angiotensin II ions as analytes in a MALDI mass spectrum. with the gate off.

FIG. 7C shows a mixture of $P_{14}R$ and angiotensin II ions as analytes in a MALDI mass spectrum. with the gate off. All molecular ions and product ions for both species are depicted. FIG. 7A shows the selection of $P_{14}R$ with the ion gate. FIG. 7B shows angiotensin II selected with the ion gate. The product ions of the molecular and product ions give structural information about the molecule. Together, the spectra show that ions can be gated to produce product spectra for multiple species in the same sample, and that the molecular structure of the product ions can be detected.

Example 4

FIGS. 8A-8D show selection of components in a lead solder sample.

Figures 8A, 8B, 8C, 8D:
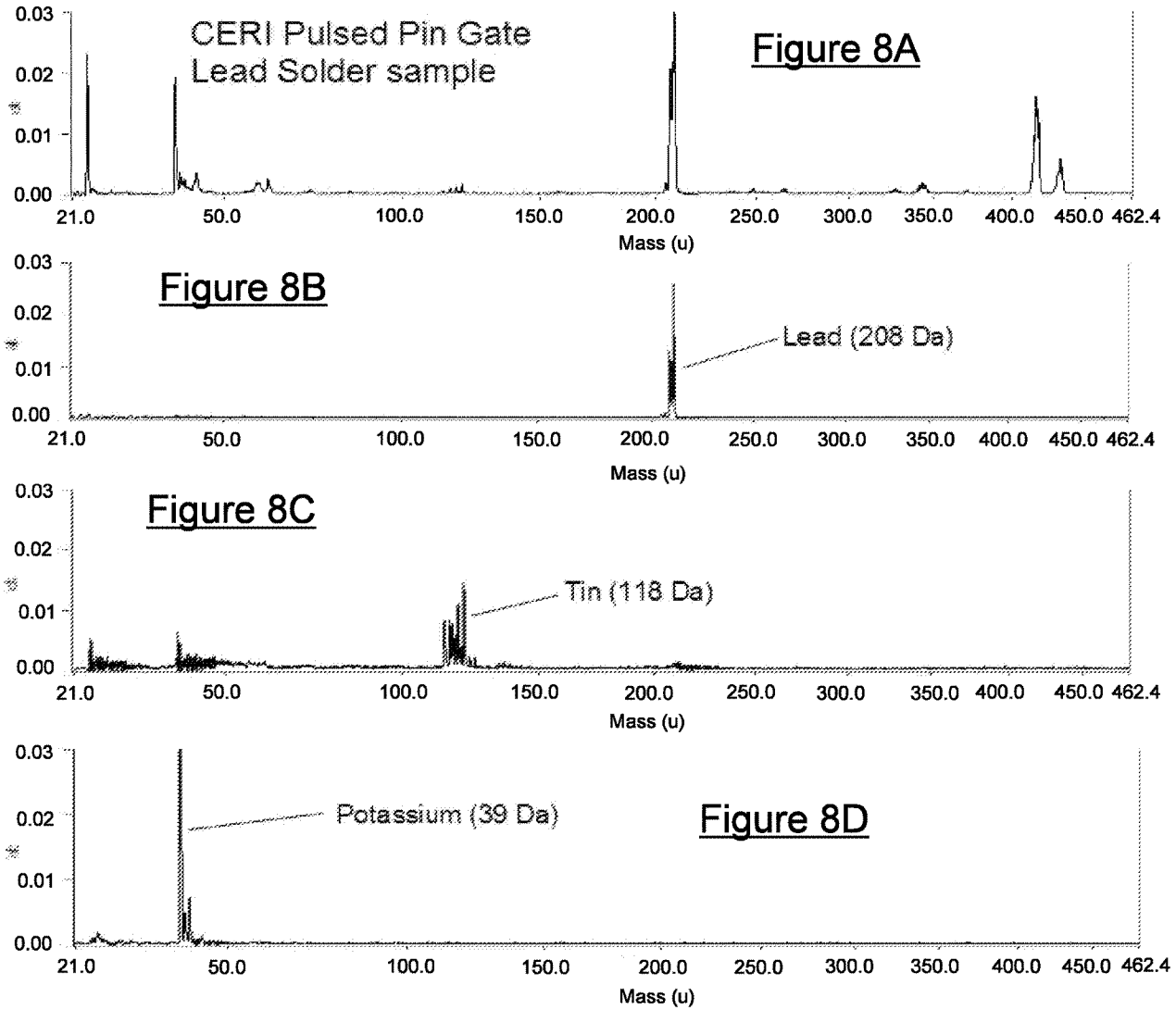
FIG. 8A shows an un-gated mass spectrum of lead solder. Lead, tin, and potassium ions all appear.
FIG. 8B shows selection of the lead peak.
FIG. 8C shows selection of the tin peak.
FIG. 8D shows selection of the potassium peak.

FIG. 8A shows an ungated mass spectrum of led solder. led, tin, and potassium ions all appear. FIG. 8B shows selection of the lead peak. FIG. 8C shows selection of the tin peak. FIG. 8D shows selection of the potassium peak.

The invention claimed is:

1. A unitary detector block configured for a time-of-flight mass spectrometer comprising:
- a center hole ion drift region in the detector block;
- a first channel plate detector mounted on the distal end of the detector block;
- a pulse pin ion gate comprising pin element positioned laterally in or laterally to the center hole.

2. A mass spectrometer comprising:
- a source region;
- a unitary detector block according to claim 1 operably associated with the source region; and
- a wire ring reflectron comprising:
  - an electrically non-conductive cylindrical frame; and
  - a plurality of conductive wire elements each surrounding the cross section of the cylindrical frame to create a cylindrical wire ring reflectron having a proximal end and a distal end;
  - wherein adjacent wire elements are each electrically connected by a resistor; and
  - wherein said wire ring reflectron is operably associated with the unitary detector block.

3. A mass spectrometer comprising:
- a source region;
- a pulse pin ion gate comprising a pin element positioned laterally in or laterally to an ion drift region associated with the source region; and
- a wire ring reflectron comprising:
  - an electrically non-conductive cylindrical frame;
  - a plurality of conductive wire elements each surrounding the cross section of the cylindrical frame to create a cylindrical wire ring reflectron having a proximal end and a distal end; said wire ring reflectron operably associated with the pulse pin ion gate.

4. The mass spectrometer according to claim 3, wherein the potential at the center of the reflectron increases linearly from the proximal end of the reflectron as a function of distance into the reflectron.

5. The mass spectrometer according to claim 3, wherein the potential at the center of the reflectron increases non-linearly with an increasing slope from the proximal end to the distal end of the reflectron.

6. The mass spectrometer according to claim 3, wherein each successive resistor in elements from the proximal end to the distal end of the reflectron has a decreased resistance.

7. The mass spectrometer according to claim 3, wherein the distance between each wire elements decreases from the proximal end of the reflectron to the distal end of the reflectron.

8. The mass spectrometer according to claim 3, wherein the potential at the center of the reflectron increases linearly from the proximal end of the reflectron as a function of distance into the reflectron.

9. The mass spectrometer according to claim 3, wherein the potential at the center of the reflectron increases non-linearly with an increasing slope from the proximal end to the distal end of the reflectron.

10. The mass spectrometer according to claim 3, wherein each successive resistor in elements from the proximal end to the distal end of the reflectron has a decreased resistance.

11. The mass spectrometer according to claim 3, wherein the distance between each wire elements decreases from the proximal end of the reflectron to the distal end of the reflectron.

12. The unitary detector block of claim 1, further comprising a second channel plate detector mounted on the proximal end of the detector block.

* * * * *